US009624733B2

(12) United States Patent
Fleetwood et al.

(10) Patent No.: US 9,624,733 B2
(45) Date of Patent: Apr. 18, 2017

(54) MODULAR ANNULAR DEBRIS BARRIER WITH ROTATIONALLY LOCKED SEGMENTS

(71) Applicant: Baker Hughes Incorporated, Houston, TX (US)

(72) Inventors: Russell K. Fleetwood, Katy, TX (US); Matthew J. Krueger, Houston, TX (US); Thorsten Regener, Wienhausen (DE); Jonathan P. Hanson, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 431 days.

(21) Appl. No.: 14/222,047

(22) Filed: Mar. 21, 2014

(65) Prior Publication Data

US 2015/0267499 A1 Sep. 24, 2015

(51) Int. Cl.

| | |
|---|---|
| ***E21B 33/12*** | (2006.01) |
| ***E21B 12/06*** | (2006.01) |
| ***E21B 17/046*** | (2006.01) |
| ***E21B 17/10*** | (2006.01) |

(52) U.S. Cl.

CPC ..... *E21B 12/06* (2013.01); *E21B 17/046* (2013.01); *E21B 17/10* (2013.01)

(58) Field of Classification Search

CPC .... E21B 17/10; E21B 17/1042; E21B 17/046; E21B 12/06

USPC ..... 166/179

See application file for complete search history.

(56) References Cited

U.S. PATENT DOCUMENTS

| | | | | |
|---|---|---|---|---|
| 2,634,145 | A * | 4/1953 | Monahan | F16J 15/3284 277/346 |
| 7,604,048 | B2 | 10/2009 | Kossa et al. | |
| 8,464,787 | B2 | 6/2013 | O'Malley | |
| 8,631,863 | B2 | 1/2014 | Heckel et al. | |
| 2007/0295504 | A1* | 12/2007 | Patel | E21B 17/028 166/263 |
| 2013/0032331 | A1* | 2/2013 | Heckel | E21B 33/1208 166/227 |
| 2013/0133879 | A1* | 5/2013 | Gorman | E21B 33/12 166/202 |
| 2013/0153302 | A1 | 6/2013 | Angelle et al. | |
| 2013/0248030 | A1* | 9/2013 | Patton | E21B 34/10 137/624.11 |

(Continued)

FOREIGN PATENT DOCUMENTS

| | | | |
|---|---|---|---|
| EP | 2322758 | A2 | 5/2011 |
| WO | 2013122589 | A1 | 8/2013 |

*Primary Examiner* — Taras P Bemko
(74) *Attorney, Agent, or Firm* — Steve Rosenblatt

(57) ABSTRACT

An annularly shaped modular debris barrier can be mounted to an internal or an external member that are spaced apart to define an annular gap that could collect debris. The modules rotationally lock. Modules have circumferential segments that can be initially spaced apart to promote flexing that can occur when there is relative axial movement between the structures that define the annular gap. The gaps between segments are circumferentially offset as between adjacent segments to create a labyrinth through which the fluid can move in opposed direction while at the same time causing the debris to be retained. The segments stay in a flexed condition to exert a contract stress on the free ends thereof that touch the adjacent structure.

19 Claims, 4 Drawing Sheets

(56) References Cited

U.S. PATENT DOCUMENTS

| | | | | |
|---|---|---|---|---|
| 2014/0054036 | A1* | 2/2014 | Regener | E21B 33/14 166/285 |
| 2014/0054043 | A1* | 2/2014 | O'Malley | E21B 33/12 166/332.2 |
| 2015/0060717 | A1* | 3/2015 | Stockberger | F16K 41/04 251/335.1 |

* cited by examiner

MODULAR ANNULAR DEBRIS BARRIER WITH ROTATIONALLY LOCKED SEGMENTS

FIELD OF THE INVENTION

The field of the invention is annular debris barriers for subterranean use and more particularly barriers that are modular where modules rotationally lock to present flexing segments in each module with gaps that are offset between the modules.

BACKGROUND OF THE INVENTION

Some subterranean equipment can be installed in boreholes for many years leaving an opportunity for debris to enter open cavities such as annular spaces between two structures that at some point need to move relatively to release or reconfigure the tool. If the debris accumulates in such spaces it has the capability of jamming the tool so that normal release is difficult if not impossible. A failure to normally release could cause the need for extraordinary and expensive measures such as a special trip to mill out the tool. Such measures are expensive and have the potential to cause other problems particularly if the generated debris from milling is not effectively removed with circulation or debris collection equipment that is in the hole.

Various designs for debris barriers have been used. A foam hollow cylinder that is mounted to an inner pipe and moved axially into a narrow annular space defined between an inner and outer tubulars is shown in FIGS. 5 and 6 of U.S. Pat. No. 8,464,787. Snap fit annular rings to go into an open annular space as a debris barrier are shown in U.S. Pat. No. 8,631,863. A foldable annular ring that employs a spring force to collapse for radial extension to protect an annular space between a string stabbed into a seal bore of a packer is shown in U.S. Pat. No. 7,604,048. Barriers that are internal to a tubular are shown in FIG. 4 of WO2013/122589. Another one-piece annular barrier is shown in FIG. 3 of EP 2322758 A2. Articulated tubular wipers that converge around a tubular as the tubular moves through where the wipers can be in single (104A) or multiple (not shown) semi-circular segments is shown in US 2013/0153302. This design is not for debris exclusion but rather is for forcibly scraping off debris from a tubular outer wall as the string is run into the borehole.

What is needed and provided by the present invention is a modular design where each module has a plurality of flexing resilient segments that can be scored or have gaps either when run in or after initial flexing where the gaps are circumferentially offset among the modules and the modules are rotationally locked to each other. The module spacing allows the segments to flex as much as 90 degrees or more before segments in one module contact segments in an adjacent module. The spacing allows fluid movement across the barrier while holding back the debris. These and other aspects of the present invention will be more readily apparent to those skilled in the art from a review of the detailed description and the associated drawings while recognizing that the full scope of the invention is to be determined from the appended claims.

SUMMARY OF THE INVENTION

An annularly shaped modular debris barrier can be mounted to an internal or an external member that are spaced apart to define an annular gap that could collect debris. The modules rotationally lock. Modules have circumferential segments that can be initially spaced apart to promote flexing that can occur when there is relative axial movement between the structures that define the annular gap. The gaps between segments are circumferentially offset as between adjacent segments to create a labyrinth through which the fluid can move in opposed direction while at the same time causing the debris to be retained. The segments stay in a flexed condition to exert a contract stress on the free ends thereof that touch the adjacent structure.

DETAILED DESCRIPTION OF THE PREFERRED EMBODIMENT

Figure 1:
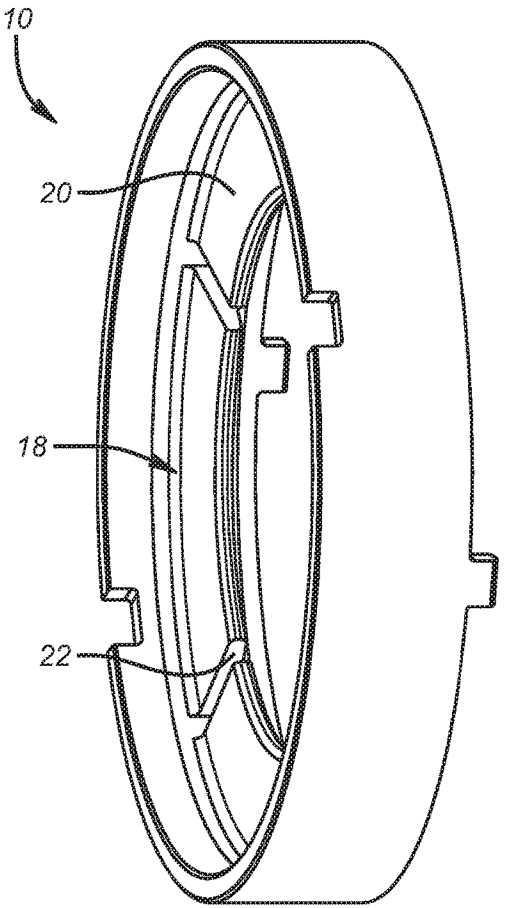
FIG. 1 is a perspective view of a single module of the debris barrier assembly.
Figure 3:
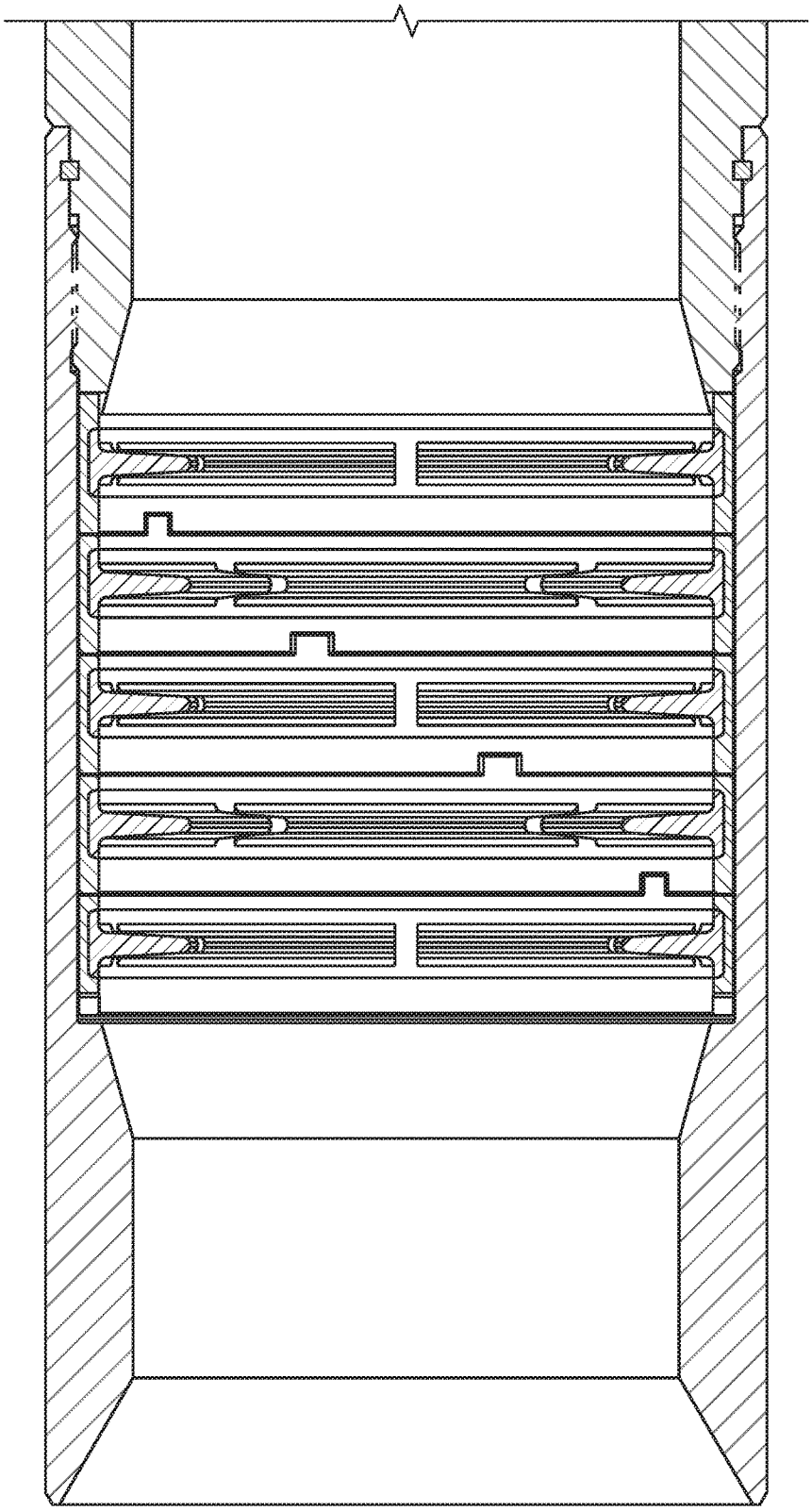
FIG. 3 is a part section view showing the offset of gaps between segments on adjacent modules.
Figure 4:
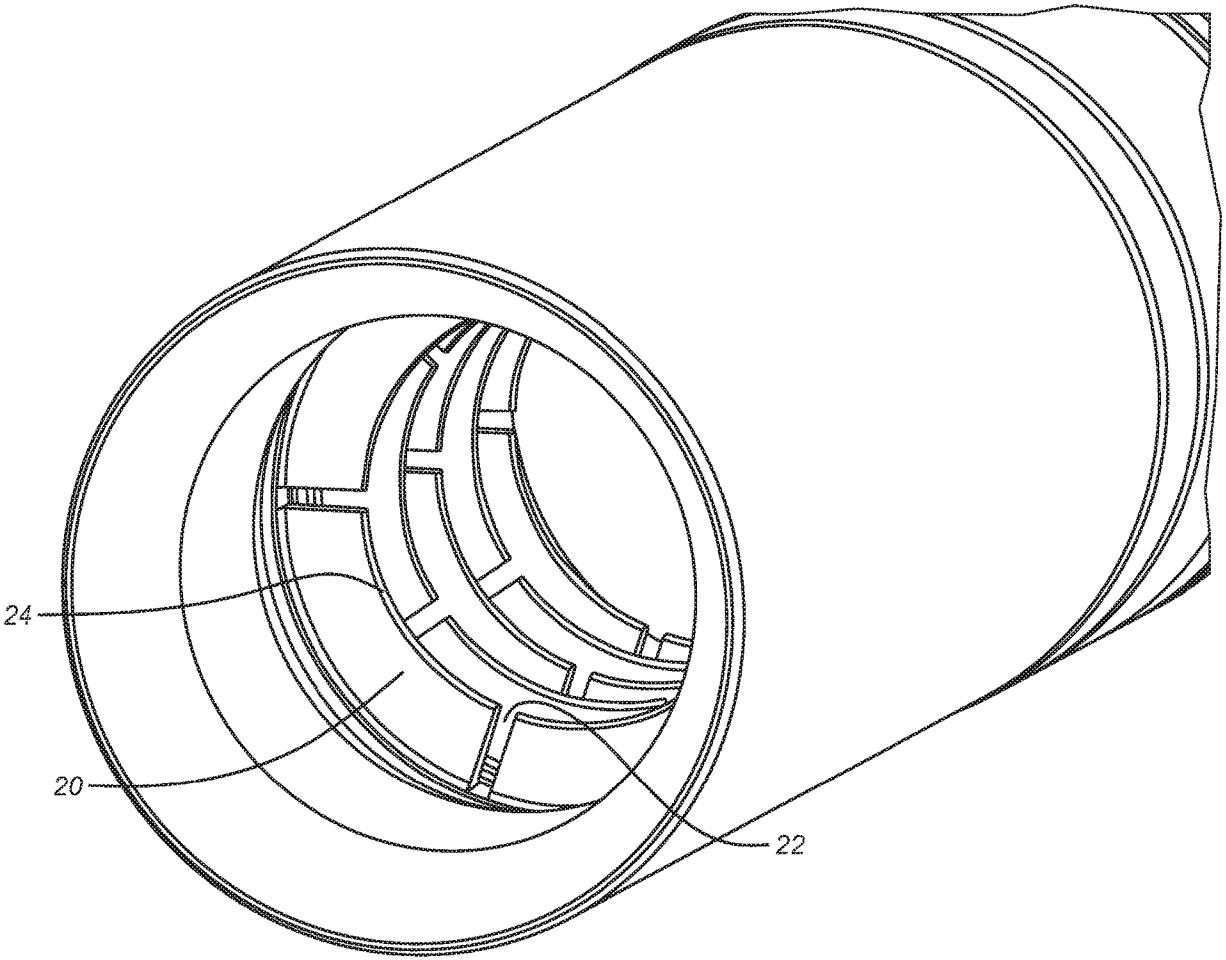
FIG. 4 is a perspective interior view of a stack of the modules shown without an internal tubular present.

FIG. 1 shows a single modular assembly 10 that is designed to fit on an outer tubular 12 that has an inner tubular 14 extending through it to define an annular gap 16 in between. Gap 16 is spanned in each assembly 10 by a flexible ring structure 18 that preferably has multiple segments 20 with intervening gaps 22. An alternative design is to have a continuous ring 18 that has circumferentially offset scores to create one or more weak points that rip or tear the first time an inner tubular 14 is inserted to create a gap similar to 22. Gaps 22 can be created with removal of a rectangular shape from an inner edge 24 that still leaves a continuous ring at mounting location 26 on outer tubular 12 with inwardly extending radial segments 28 that are shown flexed in FIG. 5 when tubular 14 is inserted. The height of each module 10 positions the mounting locations so as to allow the segments 28 to flex a full 90 degrees which could occur in situations with differential pressure, which can be transient. In the fully flexed condition, the segments 28 can be bent 90 degrees into contact with an interior surface 30 of a mounting location 26. The attachment of the mounting location 26 to the outer tubular 12 can be with an interference fit, fasteners such as circlips or/and adhesive. The ring structure 18 is preferably a resilient material that is compatible with well fluids and temperatures and can be an elastomer or a flexible metallic or a composite material.

Figure 2:
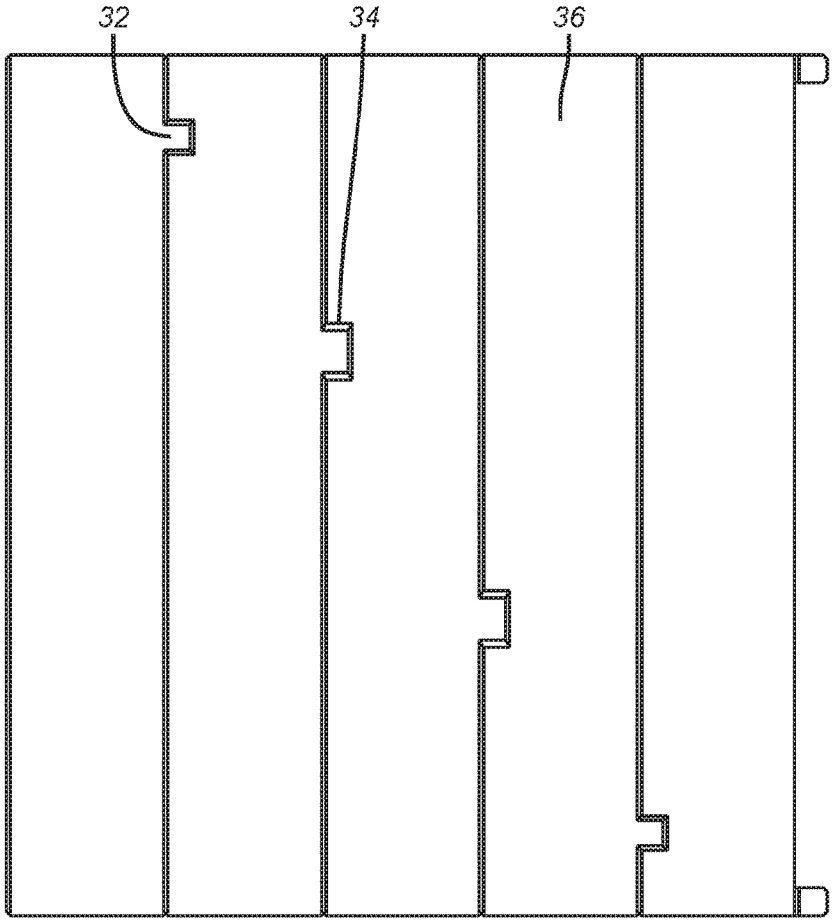
FIG. 2 is a side view of an assembly of modules showing the rotational lock feature.

The modular assembly 10 can be a stack as shown in FIG. 2 where there are rotational locks in the form of tabs 32 going into recesses 34 or some other interlocking arrangement so that gaps 22 in one module of assembly 10 is circumferentially offset from an adjacent module in assembly 10. The gaps 22 can be in a variety of shapes and do not need to extend to an edge such as 24. The can alternatively or/and additionally be radially offset in that event. Preferably, the degrees of offset for the gaps 22 as between adjacent modules is about the same as the angular spacing between gaps in a given module of assembly 10. Uniform spacing of gaps 22 and their offset between modules in an assembly 10 is preferred although unequal spacing is contemplated. The base rings 36 can be fixated between shoulders 38 and 40 that are brought together when thread 42 is made up.

Figure 5:
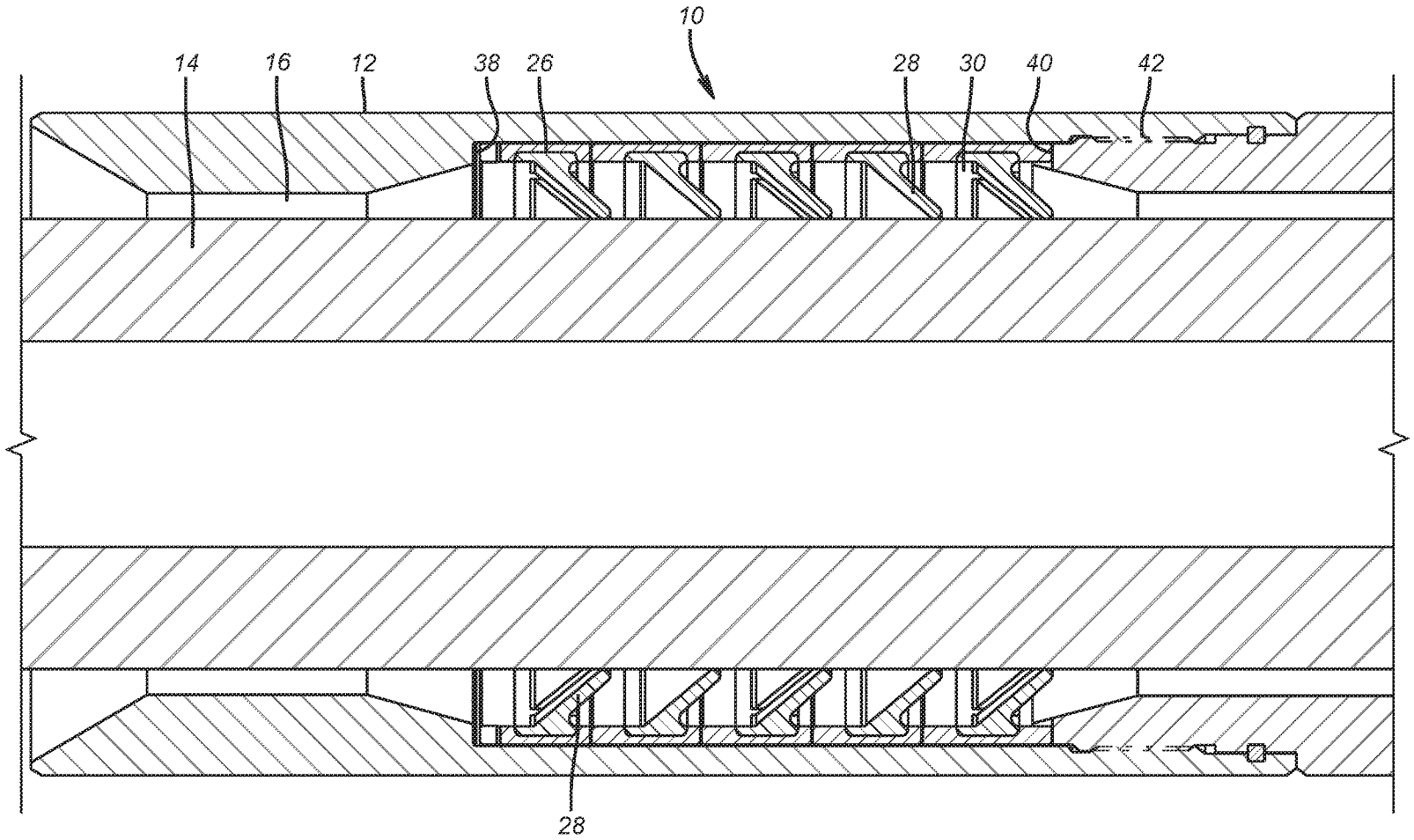
FIG. 5 is a section view showing the module stack on an outer tubular and spanning an annular gap to the inner tubular.

While FIG. 5 shows the assembly 10 mounted on an outer tubular 12, the parts could be reversed for a mounting of the assembly 10 on the inner tubular 14. In essence the assembly 10 is turned inside out and secured to tubular 14. While five modules are shown for the assembly 10 other quantities of modules can be used as determined by space limitations or the level of anticipated debris.

Those skilled in the art will appreciate that what has been described is a modular debris barrier that can be used in annular spaces particularly where some relative axial movement is contemplated and where there needs to be an ability to pass flow so that thermal or pressure gradients can be equalized across the assembly. This is to be contrasted with a solid ring design used in the past that can either be a fluid barrier itself by spanning the annular gap or become a barrier after some accumulation of debris around the small clearances or no clearances that it provides. The rotational lock feature ensures that in use the gaps do not line up to produce a straight shot for debris to advance into the annular gap that is to be protected. Additionally if there is to be a milling out of the assembly, the rotational lock facilitates millout by preventing relative sliding between adjacent modules. The barrier can be a solid ring that has gaps placed into it from an edge thereof without going clean through so at one ends there is still a cohesive ring while at an opposed end is spaced extending segments. Alternatively, spaced segments with gaps can be associated with a support ring. In another variation, a solid ring with radial scores or tears can be used to allow additional flexibility of the segments as the other tubular is inserted in the assembly for contact with the segments. The segments are preferably resiliently flexible and compatible with long term exposure to well fluids and are spaced to allow flexing for 90 degrees should well conditions create such a circumstance.

The width of the segments can be uniform or different. In that case different subsets of axially spaced segments may define a labyrinth for flow and debris retention for different sized tubulars that can be positioned in an outer tubular to define different widths for the annular space. Different sized pipes can be accommodated in the annular space with the degree of bending of some or all the segments changing depending on the size of the resulting annular space. The flexing capability of the segments also allows for debris exclusion if the annular space is not symmetrical such as when the inner and outer tubulars that define the annular space are not concentric. The size of the annular space can also vary as connection upsets move past but the flexible nature of the segments tolerates these variation while continuing to keep the debris retained on the outside of all the segments and the modules in which they are disposed.

The above description is illustrative of the preferred embodiment and many modifications may be made by those skilled in the art without departing from the invention whose scope is to be determined from the literal and equivalent scope of the claims below:

We claim:

1. A debris barrier assembly for an annular gap between a selectively separated first and a second component in a borehole, comprising:

first and second tubular members defining the annular gap in the borehole in between wherein said first tubular is selectively fully removable from said second tubular while leaving the debris barrier in place;

a plurality of stackable, discrete modules each comprising a ring shaped supporting base supporting a flexible barrier assembly extending from said base from one end thereof, said flexible barrier assemblies of adjacent stacked modules being axially spaced to create portions of a flow path between offset openings between adjacent modules to define a labyrinth flow pattern through said modules for flow of fluids while retaining debris on said flexible barrier assemblies, said flow being sufficient to allow for compensation for thermal effects on the fluids while retaining debris to facilitate subsequent removal of the first component from the second component.

2. The assembly of claim 1, wherein:

said offset is circumferential.

3. The assembly of claim 1, wherein:

said offset is radial.

4. The assembly of claim 1, wherein:

said offset is radial and circumferential.

5. The assembly of claim 1, wherein:

each said flexible barrier has a free end opposite from another end secured to said base.

6. The assembly of claim 5, wherein:

said free end spans the annular gap and is deflected by one of said components defining the annular gap.

7. The assembly of claim 1, wherein:

said modules rotationally lock.

8. The assembly of claim 7, wherein:

said rotational locking features a projection on one module fitting into a depression in an adjacent module.

9. The assembly of claim 1, wherein:

said opening comprises a radially oriented slot extending from at least one end of said barrier assemblies.

10. The assembly of claim 1, wherein:

said slot extends between opposed ends such that said barrier assemblies comprise discrete spaced segments.

11. The assembly of claim 1, wherein:

said modules are axially compressed on one of said components between a pair of mounting surfaces that are selectively brought together.

12. The assembly of claim 1, wherein:

flexible barriers in adjacent modules can flex up to 90 degrees without contacting each other.

13. The assembly of claim 1, wherein:

said at least one opening in said barrier assemblies comprise multiple openings.

14. The assembly of claim 13, wherein:

said openings are equally spaced;

said openings in adjacent modules are circumferentially offset in an amount equal to said equal spacing.

15. The assembly of claim 13, wherein:

said openings are unequally spaced.

16. The assembly of claim 1, wherein:

each said flexible barrier is secured to said base by at least one of an interference fit, a fastener and an adhesive.

17. The assembly of claim 1, wherein:

each said flexible barrier is made of at least one of an elastomer, a flexible metal and a composite material.

18. The assembly of claim 1, wherein:

said flexible barrier assemblies continuing to span said annular gap when the width of said annular gap changes due to relative axial movement of the components.

19. The assembly of claim 1, wherein:

said flexible barrier assemblies continuing to span said annular gap when the width of said annular gap changes due to relative radial movement of the components that affects their concentricity.

* * * * *